United States Patent [19]

Leifeld et al.

[11] Patent Number: 4,797,976

[45] Date of Patent: Jan. 17, 1989

[54] TEXTILE FIBER TUFT CLEANING APPARATUS

[75] Inventors: Ferdinand Leifeld, Kempen; Hermann G. Selker, Mönchengladbach, both of Fed. Rep. of Germany

[73] Assignee: Trützschler GmbH & Co. KG, Mönchengladbach, Fed. Rep. of Germany

[21] Appl. No.: 46,868

[22] Filed: May 7, 1987

[30] Foreign Application Priority Data

May 7, 1986 [DE] Fed. Rep. of Germany ..... 3615416

[51] Int. Cl.[4] ..... D01G 9/08

[52] U.S. Cl. ..... 19/200; 19/205

[58] Field of Search ..... 19/200, 205

[56] References Cited

U.S. PATENT DOCUMENTS

| | | | |
|---|---|---|---|
| 1,026,432 | 5/1912 | Dey | 19/205 X |
| 1,953,245 | 4/1934 | MacKenzie | 19/205 |
| 4,479,286 | 10/1984 | Brown et al. | 19/200 |
| 4,519,114 | 5/1985 | Rhyne | 19/200 |
| 4,637,096 | 1/1987 | Wise | 19/205 X |

FOREIGN PATENT DOCUMENTS

| | | | |
|---|---|---|---|
| 0613087 | 5/1935 | Fed. Rep. of Germany . | |
| 2431018 | 1/1976 | Fed. Rep. of Germany . | |
| 2838173 | 3/1980 | Fed. Rep. of Germany . | |
| 1118982 | 6/1956 | France | 19/205 |
| 0599995 | 6/1978 | Switzerland . | |
| 0975848 | 11/1982 | U.S.S.R. | 19/205 |
| 0001155 | of 1906 | United Kingdom | 19/205 |
| 957767 | 5/1964 | United Kingdom . | |

*Primary Examiner*—Louis K. Rimrodt

*Attorney, Agent, or Firm*—Spencer & Frank

[57] ABSTRACT

An apparatus for separating waste from textile fiber tufts includes a substantially closed casing, a separating wall arranged in the casing for dividing the casing into a dust and waste collecting chamber and a fiber collecting chamber. The separating wall has a separating surface and is provided with apertures. There is further provided an air stream guide for directing a fiber and waste-laden air stream through the apertures of the separating wall from the fiber collecting chamber to the waste collecting chamber. The apertures are sized to allow passage of dust and waste and to prevent passage of fibers. The air stream guide and the separating wall are relatively movable with respect to one another. The air stream guide is immovably supported and the separating wall is rotatable about an axis perpendicular to the separating surface of the separating wall.

15 Claims, 1 Drawing Sheet

BALE
OPENER
BO
F
FAN
1
2
2a
3
3a
3b
4
5
6
6a
7
7a
7b
8
8a
9
9a
10
11
13
A 9a
9
13
7
7a
7b
12
12a

TEXTILE FIBER TUFT CLEANING APPARATUS

BACKGROUND OF THE INVENTION

This invention relates to an apparatus for cleaning textile fiber tufts and is of the type which has an essentially closed cleaning housing provided with a perforated inner separating wall which divides the housing into a dust and waste collecting chamber and a fiber collecting chamber. The perforations (openings) provided in the separating wall have a predetermined size to permit passage of wastes in the fiber but to prevent the fibers from passing therethrough. There is further provided an air stream guide element for guiding the fiber present in the air stream onto the separating wall. The guide element and the separating wall are movable relative to one another.

U.S. Pat. No. 4,519,114 discloses an apparatus in which the air stream guide elements are movable components providing a cyclically reversed guidance of the fibers present in the air stream. The fiber-laden air is guided back-and-forth transversely in front of the separating wall. It is a disadvantage of this arrangement that the reversal of air flow is abrupt and further, that the air guide elements add to the structural expense of the apparatus.

SUMMARY OF THE INVENTION

It is an object of the invention to provide an improved apparatus of the above-outlined type from which the discussed disadvantages are eliminated and with which the degree of cleaning and de-dusting is significantly increased.

This object and others to become apparent as the specification progresses, are accomplished by the invention, according to which, briefly stated, the air stream guide element is held stationarily and the separating wall is rotatable about an axis which is perpendicular to the surface of the separating wall.

According to the invention, the relative motion between the fiber tuft stream and the separating surface (sweeping motion) is significantly increased because no sudden accelerations and jars appear as it has been the case in prior art constructions during reversal of the guide elements. It is a further advantage of the invention that the dwelling period during moments of reversal disappear. In addition to the sweeping force generated by the stream, a centrifugal force for dislodging the fibers from the separating surface is also effective. This makes possible a higher impact velocity and passage speed through the openings (holes) of the separating wall. Otherwise, the tufts would be pressed with an excessive force into the openings which would cause their adherence thereto and would thus not fall out by themselves. The momentarily effective separating surface is exposed to the entire suction effect which, in the known device, is distributed over the entire machine width. This arrangement is advantageous because for a given identical air quantity and identical pressure difference a significantly higher flow velocity through the perforations is achieved which results in a significant increase in the de-dusting effect with the same energy input. Conversely, if identical de-dusting effects are desired, the energy input may be significantly reduced compared to prior art constructions. Further, the invention provides for more significant friction forces between the fibers and the separating wall. In the known construction, the air stream at the points of reversal causes a particularly pronounced disadvantageous fiber passage through those points, and for this reason the holes have to be maintained small in the known construction. Thus, according to the invention larger holes or slots may be used because by virtue of the rapidly moved surface the fibers may impinge at a more acute angle for the relative velocity. By virtue of the motion provided according to the invention, the air does not rush through the holes with the previously experienced intensity and thus the fibers are captured at an edge of the holes or slots, and they are then entrained and hurled away. In this manner an intentional wall/fiber friction is generated which has a significant dust and trash dislodging effect.

According to an advantageous feature of the invention, the separating wall is circular and is expediently a planar disc. According to another advantageous embodiment of the invention, the separating wall is conical or hemispherical. Preferably, the air guide element is oriented substantially perpendicularly to the separating wall.

According to another advantageous feature of the invention, on that side of the separating wall which is oriented away from the air stream guide element there is arranged a suction element, such as a tubular conduit. The latter lies immediately across the outlet of the air guide element, such as a tubular conduit. Expediently, the inlet area of the suction conduit is essentially of the same magnitude as the impingement face of the separating wall for the fiber material. Preferably, the rotating separating wall is associated with an rpm-variable drive element connected with a control and regulating device in which the rpm of the drive element is settable. Preferably, in the housing wall, for example, in the fiber collecting chamber, there is arranged an adjustable air outlet opening.

DESCRIPTION OF THE PREFERRED EMBODIMENT

The apparatus according to the invention may find application essentially at any desired location of a conventional cotton cleaning line for cleaning cotton fiber tufts to remove small waste. For example, the construction according to the invention may be situated between a gin and a bale press in the first machine assembly for processing harvested cotton. Also, the apparatus according to the invention may be situated in a typical yarn making installation at a location after the bale opener and before the carding preparation (cleaning line). Such installations are known and are therefore not described in detail.

Figure 1:
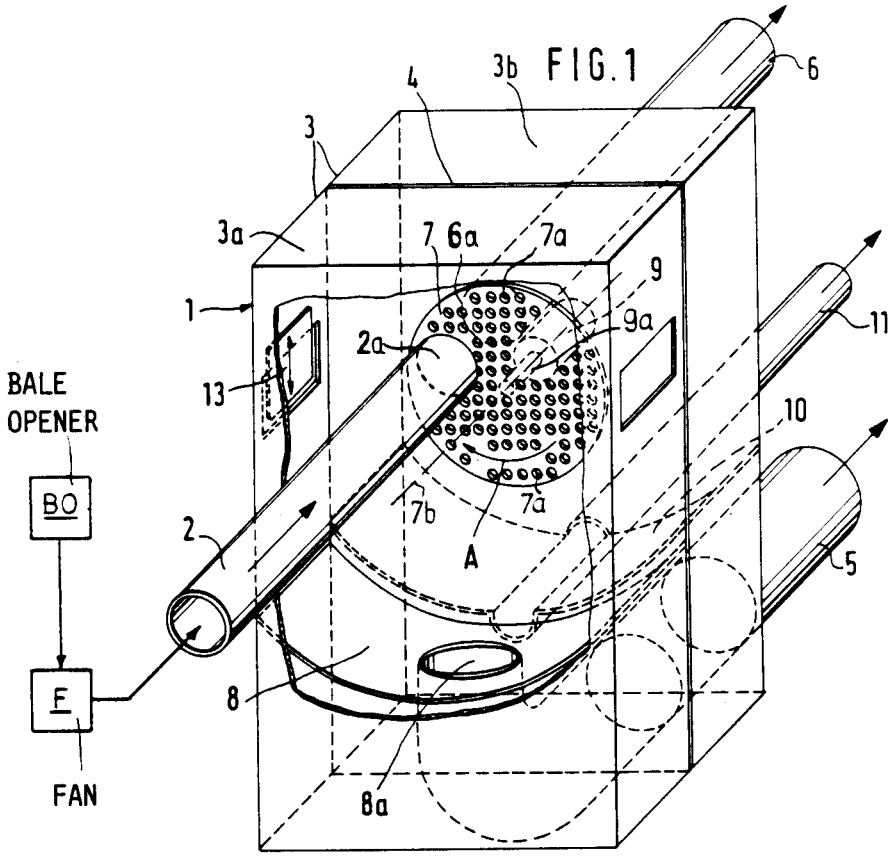
FIG. 1 is a perspective view of a preferred embodiment of the invention.

Turning to FIG. 1, a cleaning housing 1 is connected with a high speed fan F by means of a tubular conduit 2. The housing 1 is essentially a closed, upright oriented, rectangular casing 3 which may be made of sheet metal and encloses an inner septum 4 which extends essentially vertically along the entire height of the casing 3 between the oppositely located side walls thereof to divide the housing 1 into a fiber collecting chamber **3*a* and a waste collecting chamber 3*b* on respective opposite sides of the septum 4. The fan F may be a conventional centrifugal fan whose inlet (suction side) is connected with a fiber tuft source such as the outlet of a bale opener BO or the like and whose outlet (pressure side) is connected by means of the tubular conduit 2 stationarily supported in the frontal wall of the casing 3 on the side of the fiber collecting chamber 3***a*.

The outlet end 2*a* of the tubular conduit 2 which is at a distance from the septum 4 may project into the chamber 3*a*. Another tubular conduit 5 is connected with the casing 3 at its lower end and opens into the fiber collecting chamber 3*a*. The conduit 5 extends therefrom to the subsequent processing machines such as the inlet of a bale press, a bale opener (which may be a "BLENDOMAT" model manufactured by Trützschler GmbH & Co. KG, Mönchengladbach, Federal Republic of Germany), a mixer, a cleaner, a beater, a card feeder or the like. An air outlet conduit 6 (suction conduit) is connected with the rear wall of the casing 3 and opens into the waste collecting chamber 3*b* with an inlet opening 6*a*. A non-illustrated door is provided at the lower end of the rear wall of the casing 3 to permit an access to the waste collecting chamber 3*b*.

In the impervious septum 4 there is provided a circular opening which accommodates a planar separating wall (separating disc) 7 which is provided with a plurality of holes 7*a* and which is rotated in the direction of the arrow A by a motor 9 situated in the waste collecting chamber 3*b*. The rotary axis 7*b* of the separating wall 7 is perpendicular to the surface of the separating wall 7. The shaft 9*a* of the motor 9 is connected to the center of the circular separating wall 7. It is feasible to arrange the motor 9 externally of the casing 3 as well. The openings (such as holes 7*a*), may be apertures in sieves, wire meshes, fabrics, perforated panels, or may be gaps, slots, comb-like walls or the like.

It is known that the conventional processing, for example, ginning of fiber material upstream of the apparatus according to the invention effects the elimination of preponderantly large particles of waste and foreign bodies. This processing, however, is in general not adapted to remove small parts such as dust, microdust, leaf fragments, seed casings and other plant particles gathered from the cotton field or other impurities. The perforations of the separating disc 7 have preferably a predetermined size to permit the passage of the above-noted small impurities, but these openings are sufficiently small to prevent passage of cotton tufts. Preferably, the separating disc 7 is a sieve material whose mesh width may be selected to be coarse or fine according to requirements. Typically, the area of the openings may be 7 $mm^2$.

Underneath the separating disc 7 there is provided an arcuate catching element 8 which has an opening 8*a* within the fiber collecting chamber 3*a* for collecting fiber tufts dropping from the separating disc 7 and for suction removal thereof through the conduit 5. The fan F generates a sufficiently high air speed in order to ensure that the cotton tufts in the tubular conduit 2—which is oriented perpendicularly to the separating disc 7—travel with a sufficient speed from the fan substantially horizontally into the fiber collecting chamber 3*a* to cause them to impinge against the separating disc 7.

The inlet opening 6*a* of the suction conduit 6 is arranged immediately across the outlet opening 2*a* of the conduit 2 on that side of the separating disc 7 which is oriented away from the tubular conduit 2. The cross-sectional area of the suction conduit 6 is essentially as large as the impingement area on the separating disc 7, momentarily receiving the fiber tufts exiting the conduit 2. In the wall of the housing 1, for example, in the wall of the fiber collecting chamber 3*a*, there is provided a settable air equalizing opening 13.

In the description which follows, the operation of the above-described construction will be set forth.

First the fan F and the motor 9 are electrically switched on together with the other elements of the installation. The cotton tufts are carried to the inlet of the fan which emits a rapid air stream, entraining the cotton tufts. Thus, the latter are pneumatically conveyed through the conduit 2 and the fiber collecting chamber 3*a* and impinge with great force against the separating disc 7 while the air stream passes through the openings 7*a* thereof. The impingement of the fiber tufts against the separating wall 7 causes a dislodging and separation of a large proportion of foreign bodies from the fibers which in a large part, because they have a relatively small size, are carried with the air stream through the openings 7*a* into the waste collecting chamber 3*b* in which the impurities are collected in the collecting device 10 and are removed by suction through the conduit 11. The air stream is led away through a non-illustrated filter and the air outlet conduit 6 provided in the rear wall of the casing 3 in order to prevent the separated impurities from returning through the separating disc 7 into the fiber collecting chamber 3*a*. The cotton fiber tufts fall by gravity from the separating disc 7 after they impinge thereon. However, there is, to be sure, a natural tendency for the moving force of the air stream to effectively cause one part of the fiber tufts to adhere to the separating disc 7 whereupon a continued collection of fibers on the separating disc 7 could clog the passages for the air stream and the impurities and thus impede the desired cleaning process. Such an occurrence is prevented by the rotating separating disc 7. The fibers are, after their impingement, entrained by the separating disc 7 and led out of the range of the air stream in order to make possible that the fibers fall freely by gravity from the separating disc 7 into the removal conduit 8 to be further transported for subsequent processing such as a bale press, a cleaner, a beater or a card feeder. In this manner, an accumulation of fibers on the separating disc 7 by the effect of the driving air stream is effectively prevented and the intended mode of operation of the apparatus and method is usefully effected. Advantageously, the cotton fibers cleaned more effectively by the apparatus according to the invention make possible a spinning of a cleaner and qualitatively improved fiber yarn by the yarn making machine.

Figure 2:
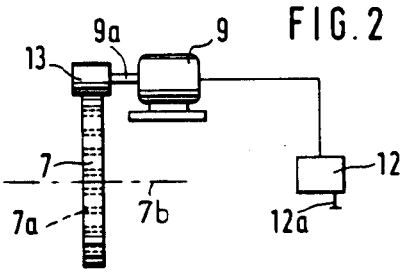
FIG. 2 is a schematic view illustrating a variant of a drive for one of the components of the preferred embodiment.

Turning to now to FIG. 2, according to the embodiment shown therein the separating disc 7 is driven peripherally by a drive roller 11 connected with the motor 9 by means of the motor shaft 9*a*. The motor 9 is an rpm-variable motor such as a d.c. motor and is electrically connected with a regulating and control device 12. The rpm of the motor 9 and thus that of the separating disc 7 may be adjusted in this manner. A desired value setter 12*a* may apply a desired rpm value to the regulating device 12. If necessary, the rpm may also be set or varied manually.

The regulating and control device 12 may be a microcomputer TMS model, manufactured by Trützschler GmbH & Co. KG, Mönchengladbach, Federal Republic of Germany.

The present disclosure relates to subject matter contained in Federal Republic of Germany Patent Application No. P 36 15 416.4 (filed May 7th, 1986) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In an apparatus for separating waste from textile fiber tufts including a substantially closed casing, a separating wall arranged in the casing for dividing the casing into a dust and waste collecting chamber and a fiber collecting chamber; said separating wall having a separating surface and being provided with apertures; air stream guide means for directing a fiber and waste-laden air stream through said apertures from the fiber collecting chamber to said waste collecting chamber; said apertures being sized to allow passage of dust and waste and to prevent passage of fibers; said air stream guide means and said separating wall being relatively movable with respect to one another; the improvement wherein said air stream guide means comprises a pressure conduit having an outlet end situated in the fiber collecting chamber at said separating wall, an air pressure generating means communicating with said pressure conduit for driving said fiber and waste-laden air stream through said pressure conduit and out of said outlet end towards said separating surface, and an air suction means including a suction conduit having an inlet opening situated in the waste collecting chamber at said separating wall; said suction conduit being arranged for guiding away dust passing through said apertures; and further wherein said pressure conduit is immovably supported and said separating wall is rotatable about an axis perpendicular to said separating surface of said separating wall; the improvement further comprising an air equalizing opening provided in a wall of said casing.

2. An apparatus as defined in claim 1, wherein said apertures comprise generally circular holes.

3. An apparatus as defined in claim 1, wherein said apertures comprise slots.

4. An apparatus as defined in claim 1, wherein said pressure conduit and said suction conduit are oriented substantially perpendicularly to said separating wall.

5. An apparatus as defined in claim 1, further comprising means for adjusting said air equalizing opening.

6. An apparatus as defined in claim 1, wherein said separating wall is circular.

7. An apparatus as defined in claim 6 , wherein said separating wall is a planar disc.

8. An apparatus as defined in claim 6, wherein said separating wall is of conical shape.

9. An apparatus as defined in claim 6, wherein said separating wall is of semi-spherical shape.

10. An apparatus as defined in claim 1, further comprising an rpm-variable drive means for rotating said separating wall.

11. An apparatus as defined in claim 10, further comprising a control and regulating means for setting the rpm of said separating wall.

12. An apparatus as defined in claim 1, further comprising an additional suction conduit communicating with said fiber collecting chamber and arranged for guiding away fibers separated from said air stream by said separating wall.

13. An apparatus as defined in claim 1, further comprising an additional suction conduit communicating with said waste collecting chamber at a location below said inlet opening for guiding away additional dust and waste passing through said apertures.

14. An apparatus as defined in claim 1, wherein said outlet end of said pressure conduit and said inlet opening of said suction conduit are in alignment with one another.

15. An apparatus as defined in claim 1, wherein said outlet end of said pressure conduit defines an impingement area of said fiber tufts on said separating wall; said inlet opening of said suction conduit having an area being substantially identical to said impingement area.

* * * * *